US005987766A

United States Patent [19]

Wawczak

[11] Patent Number: 5,987,766

[45] Date of Patent: Nov. 23, 1999

[54] BUMPER POST POSITIONING DEVICE

[76] Inventor: Todd B. Wawczak, 488 Oak St., Lockport, Ill. 60441

[21] Appl. No.: 08/985,804

[22] Filed: Dec. 5, 1997

[51] Int. Cl.[6] ..... G01D 21/00

[52] U.S. Cl. ..... 33/613; 52/127.2

[58] Field of Search ..... 248/345.1, 220.1, 248/354.5, 354.6; 33/613; 269/904, 43, 69, 211, 910; 52/127.2; 29/464, 468

[56] References Cited

U.S. PATENT DOCUMENTS

| | | | |
|---|---|---|---|
| 1,482,086 | 1/1924 | Mayworm | 2478/354.6 |
| 2,502,166 | 3/1950 | McKay | 269/904 X |
| 2,509,236 | 5/1950 | Komar | 33/613 X |
| 2,568,233 | 9/1951 | Hamilton | 269/43 |
| 2,799,093 | 7/1957 | Miller | 33/613 X |
| 3,035,805 | 5/1962 | Blank | 248/354.5 |
| 3,201,874 | 8/1965 | Christy | 33/613 |
| 3,888,477 | 6/1975 | Tate | 33/613 X |
| 4,674,730 | 6/1987 | Roberts | 269/43 |
| 4,704,829 | 11/1987 | Baumker, Jr. | 269/43 X |
| 5,520,360 | 5/1996 | Wensman | 248/354.5 |
| 5,628,119 | 5/1997 | Bingham et al. | 33/613 |
| 5,820,119 | 10/1998 | Cachon, Sr. | 269/37 |

FOREIGN PATENT DOCUMENTS

| | | | |
|---|---|---|---|
| 2600360 | 12/1987 | France | 52/127.2 |
| 5-222842 | 8/1993 | Japan | 42/127.2 |

*Primary Examiner*—Leslie A. Braun
*Assistant Examiner*—Stephen S. Wentsler
*Attorney, Agent, or Firm*—Cherskov & Flaynik

[57] ABSTRACT

A device 10 for positioning a bumper post 12 adjacent to a structure 14 to guard against a moving vehicle engaging the structure 14. The device 10 includes joined wall 16 and wall angle members 36 and 38 for engaging the structure 14, joined post channels and post angle members 78 and 86 for engaging the bumper post 12, and adjustably joining the wall member 16 and post channels 78 to predetermined settings corresponding to a predetermined distance that the bumper post 12 is positioned from the structure 14.

2 Claims, 9 Drawing Sheets

BUMPER POST POSITIONING DEVICE

BACKGROUND OF THE INVENTION

1. Field of the Invention

The present invention relates generally to devices used to position posts and, more particularly, to a device for positioning bumper posts adjacent to a structure thereby protecting the structure from being "bumped" by moving vehicles.

2. Background of the Prior Art

Bumper posts used to protect structures from being hit by moving vehicle are well known. Generally, those posts are positioned by first measuring a distance from a structure to be protected, digging a hole to receive a concrete footing in which a bottom portion of the post is secured, and at the same time, vertically aligning the post so as to make the post plumb. The problem with this method of installing bumper posts is that it requires several persons plus bracing to maintain a vertical position and prevent movement when concrete is poured about the bottom of post for anchoring thereby making the method slow and expensive. Further, even with the bracing and personnel, the bumper post may move enough to require the post to be realigned which would be much more difficult once the concrete has been poured around the post's base making the installation process even more expensive and time consuming.

The problem with the above installation method is that it does not utilize adjacent structures to secure and align the bumper post which would reduce the time and manpower required to position the bumper guard. A need exists in the art for an inexpensive, quick set-up device for installing bumper posts positioned adjacent to fixed structures.

SUMMARY OF THE INVENTION

It is an object of the present invention to provide a device for positioning and installing bumper posts that overcomes many of the disadvantages of the prior art.

A principal object of the present invention is to provide a device to distance a bumper post a predetermined dimension from a fixed structure. A feature of the device is an adjustable joining between a wall member and a post member. An advantage of the device is that the distance between a protected structure and a bumper post may be easily varied.

Another object of the present invention is to provide a wall angle member secured to the wall member that engages the structure. A feature of the device is a substantially right angle formed between the wall angle member and the wall member. An advantage of the device is to secure the joined wall and post members to the structure.

Another object of the present invention is to provide a post angle member secured to post channels that engage the bumper post. A feature of the device is a substantially right angle formed between the post angle member and the post channels. An advantage of the device is to secure the bumper post to the post channels and angle members thereby directly securing the bumper post to the structure and preventing movement of the bumper post during installation.

Yet another object of the present invention is to provide a plurality of offset channels connected to portions of the wall and wall angle members, and the post channels and post angle members. A feature of the device is to offset the wall member and the wall angle members from the structure, and to offset the post channels and the post angle members from the bumper post. An advantage of the device is to vary the distance and alignment of the bumper post in relation to the structure that the bumper post ultimately protects.

Briefly, the invention provides a bumper post positioning device comprising a wall member in communication with a wall of a structure; a post member in communication with a bumper post; means for adjustably joining said wall member and said post member; means for securing said wall member to said wall of said structure; and means for securing said bumper post to said post member.

BRIEF DESCRIPTIONS OF THE DRAWINGS

The foregoing invention and its advantages may be readily appreciated from the following detailed description of the preferred embodiment, when read in conjunction with the accompanying drawings in which:

FIG. 1 an exploded perspective view of a bumper post positioning device in accordance with the present invention.

DESCRIPTION OF THE PREFERRED EMBODIMENT

Figure 5:
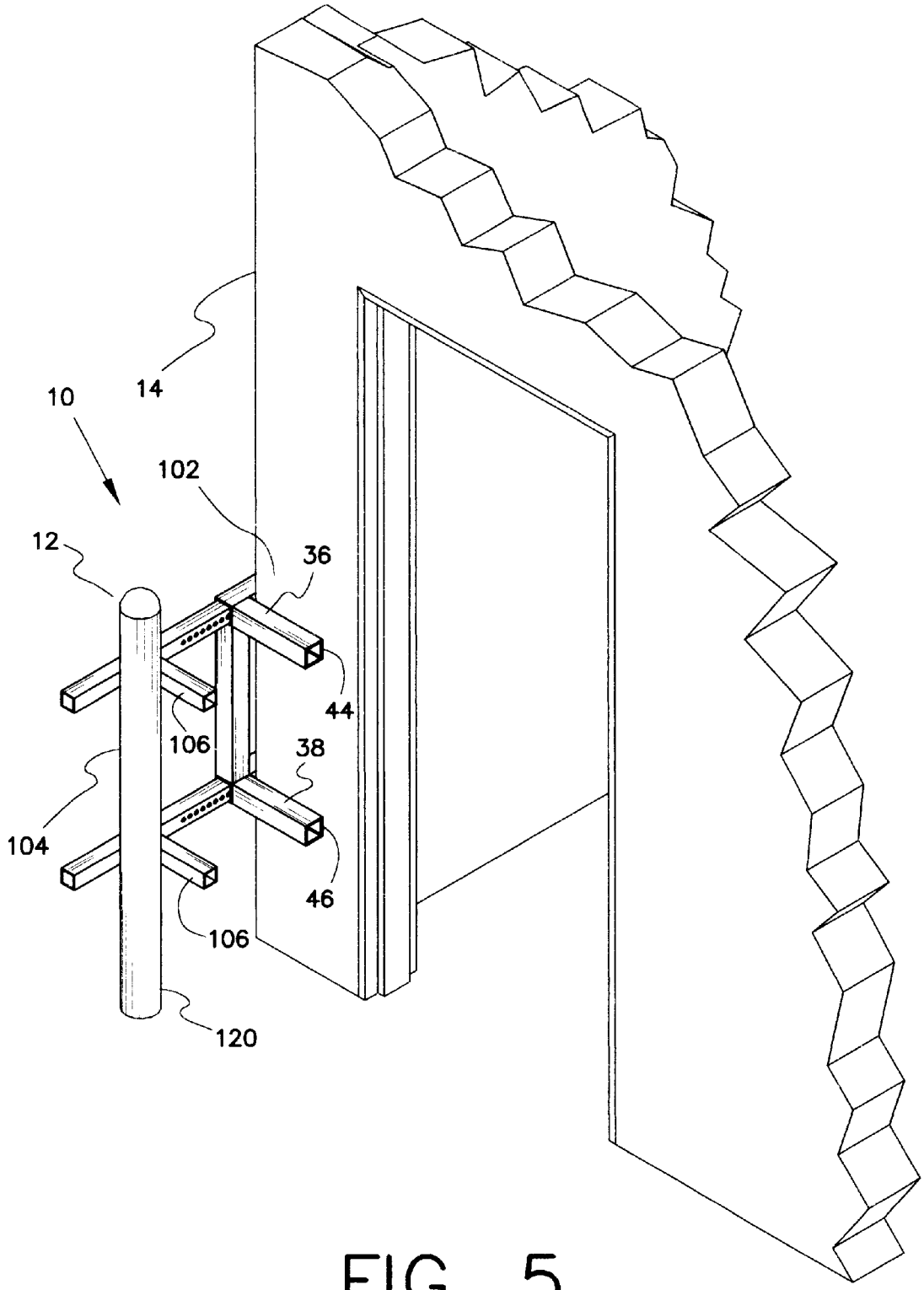
FIG. 5 is a perspective view of the device positioning a bumper post adjacent to a structure in accordance with the present invention.

In the illustrations given and more particular to FIG. 5, the reference numeral 10 designates generally a device or tool for aligning bumper posts 12. A bumper post 12 has a substantially cylindrical configuration fabricated from concrete or formed from a pipe filled with concrete. The elevation of the bumper post 12 is high enough to engage any vehicle that might be proximally positioned near a structure 14 that the bumper post 12 protects. The bumper post 12 must be anchored firmly to withstand forceful engagements with heavy and relatively fast moving vehicles including tractor trailer trucks.

Figure 1:
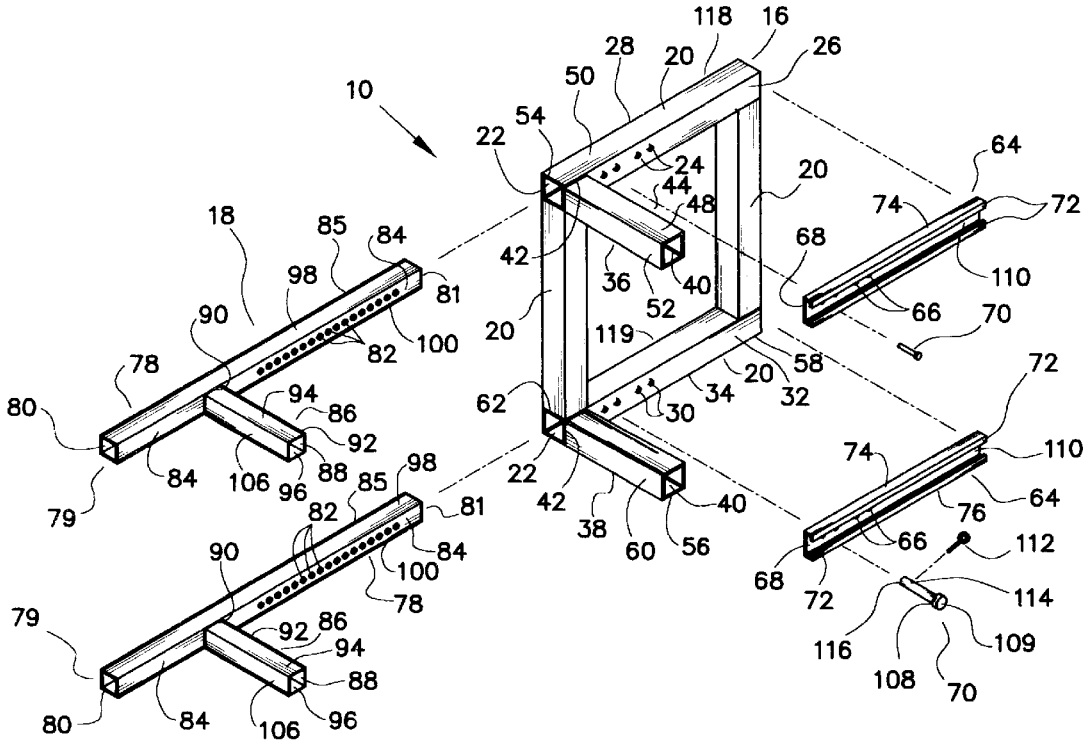
Figure 2:
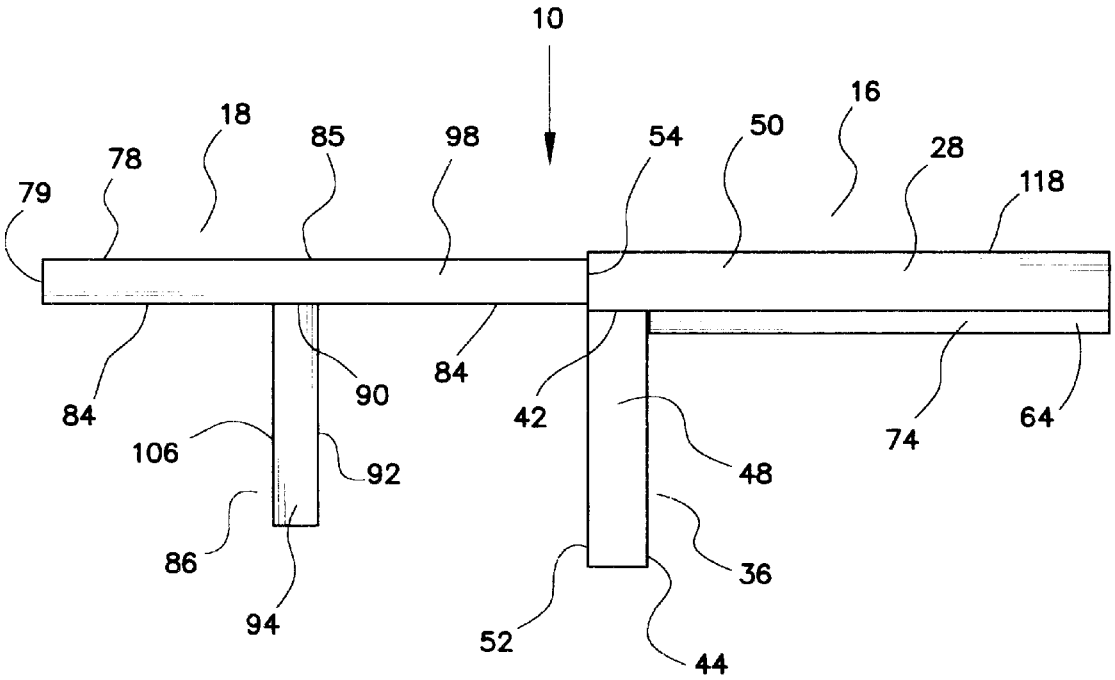
FIG. 2 is a top elevation view of the device of FIG. 1.
Figure 3:
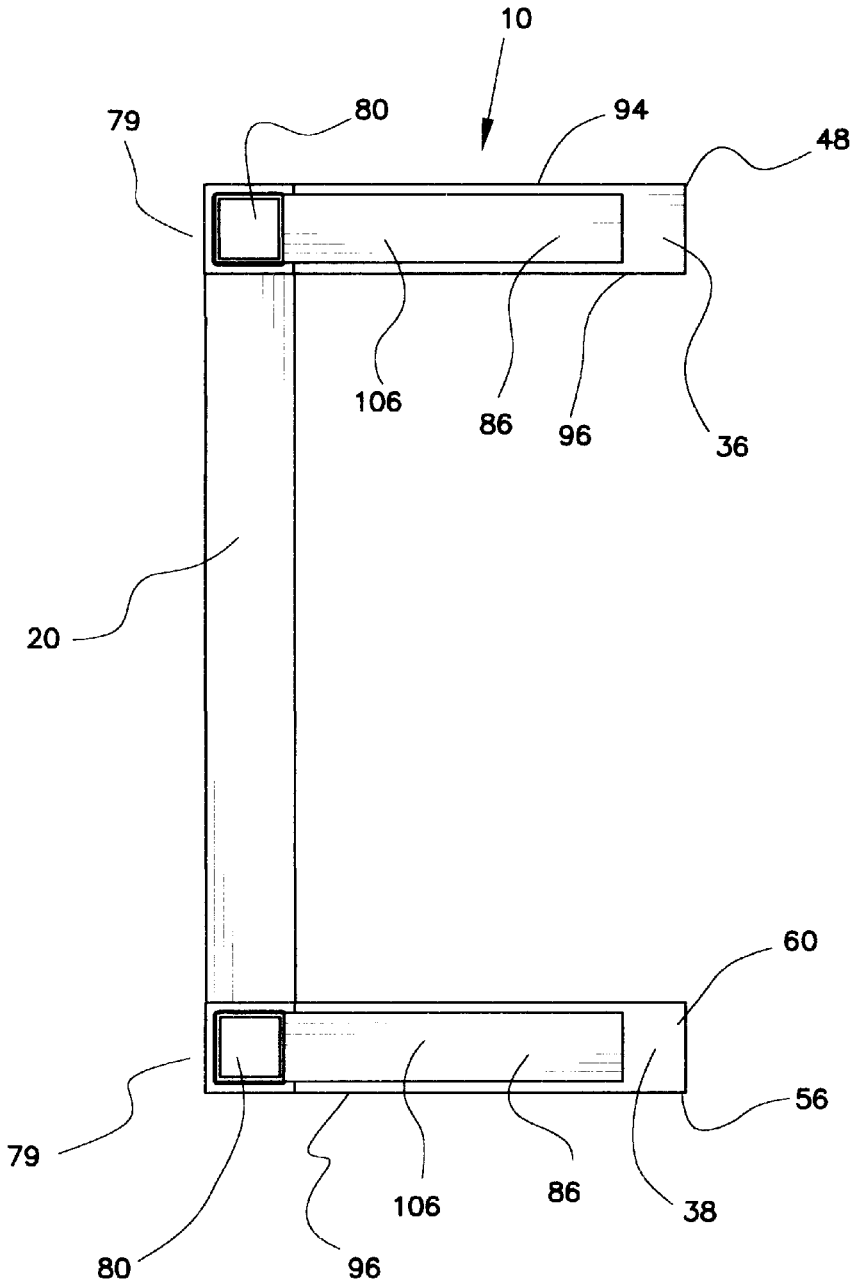
FIG. 3 is a side elevation view of the device of FIG. 1.
Figure 4:
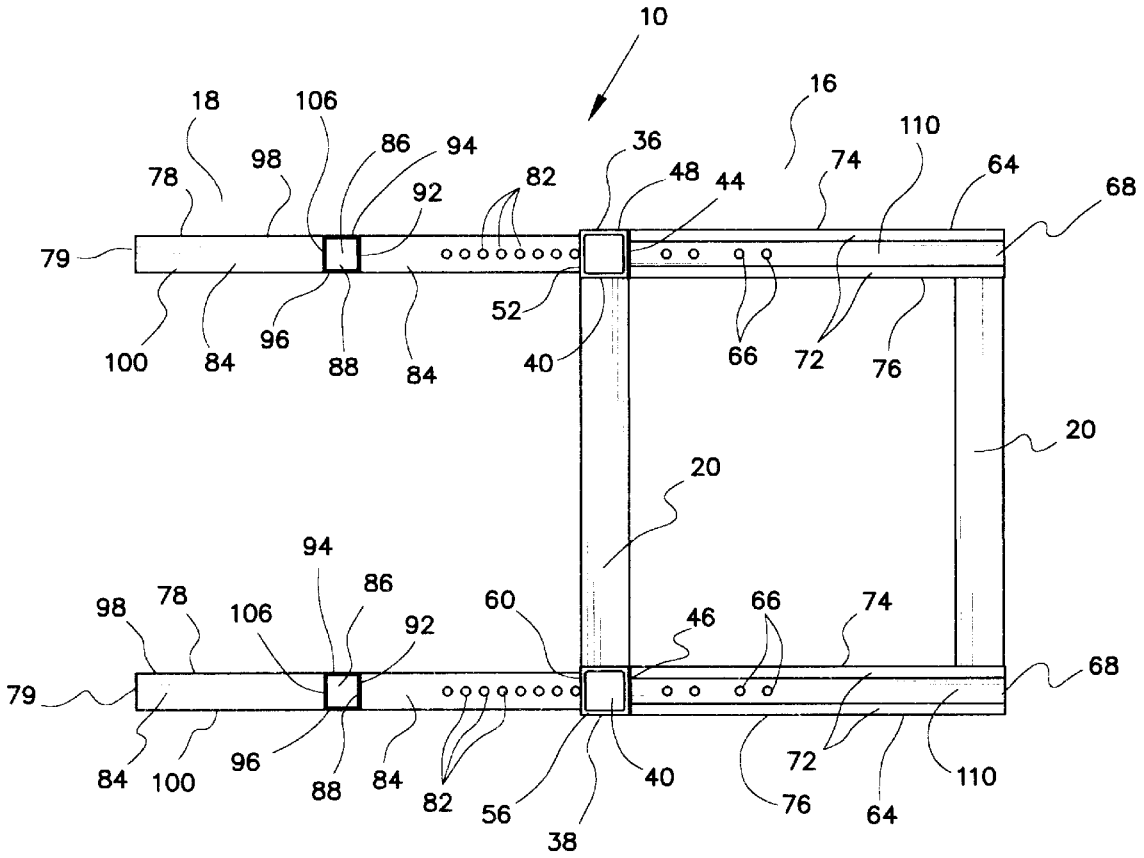
FIG. 4 is a front elevation view of the device of FIG. 1.

Referring to FIG. 1, an exploded perspective view of a device 10 aligning bumper posts 12 is depicted in accordance with the present invention. The device 10 is fabricated from a myriad of materials including metal, wood or plastic. However, the preferred material of manufacture is a lightweight aluminum which provides corrosion resistance and durability plus an overall weight small enough to allow one person to support the device 10 while aligning a bumper post 12. The device 10 includes a first member or wall member 16, and a second member or post member 18. The wall member 16 has a substantially square configuration when taking a front elevation view of the device 10 (see FIG. 4), and fabricated from four equally dimensioned channels 20. The channels 20 have a substantially square configuration when taking a side view of the device 10 (see FIG. 3) including a cavity or passageway 22 therethrough, and a substantially rectangular configuration when taking top and front elevation views of the device 10 (see FIGS. 2 and 4) with longitudinal dimensions substantially larger than lateral dimensions. The four channels 20 are joined such that horizontal channels 20 have exposed ends and vertical channels 20 have ends joined to planar walls of the horizontal channels 20 whereby a square is formed with coplanar walls formed between corresponding adjacent walls of joined vertical and horizontal channels 20. A plurality of orifices 24 are positioned along the longitudinal midsection of an upper channel 28 and relatively equally spaced through inner and outer planar walls 26 and 118 of the upper channel 28 of the wall member 16. A plurality of orifices 30 are positioned along the longitudinal midsection of a lower channel 34 and relatively equally spaced through inner and outer planar walls 32 and 119 of the lower channel 34 of the wall member 16.

The device 10 includes an upper wall angle member 36 integrally joined to the inner wall 26 of the upper channel 28, and a lower wall angle member 38 integrally joined to the inner wall 32 of the lower channel 34. The upper and lower wall angle members 36 and 38 have a substantially square configuration when taking a front elevation view of the device 10 (see FIG. 4) including a passageway 40 therethrough, and a substantially rectangular configuration when taking top and side elevation views of the device 10 (see FIGS. 2 and 3) with longitudinal dimensions relatively larger than lateral dimensions but smaller than the wall channels 20 longitudinal dimension. The wall angle members 36 and 38 are integrally joined to respective planar inner walls 26 and 32 by welding the perimeter of the square configured ends 42 to the inner walls 26 and 32. The angle members 36 and 38 are joined to the inner walls 26 and 32 such that the longitudinal axes of the angle members 36 and 38 are substantially perpendicular to respective inner walls 26 and 32 thereby forming substantially right angles between inner walls 26 and 32 and respective adjacent inner walls 44 and 46 of the wall angle members 36 and 38. Further, joined angle member 36 is positioned such that upper wall 48 is planar with upper wall 59 of upper channel 28, and outer wall 52 of angle member 36 is planar with end 54 of the upper channel 28. Joined angle member 38 is positioned such that lower wall 56 is planar with lower wall 58 of lower channel 34, and outer wall 60 of angle member 38 is planar with end 62 of the lower channel 34.

The device 10 includes two offset channels 64 removable received upon the inner walls 26 and 32 of the upper and lower channels 28 and 34. The channels 64 include a plurality of orifices 66 dimensioned and positioned to congruently align with respective orifices 24 and 30 of the inner walls 26 and 32. The orifices 66 are linearly positioned at the longitudinal midsection of the offset channels 64. The offset channels 64 are configured in substantially a "C" configuration, when taking a side view, to form a trough 68 that allows a locking pin 70 to be inserted between opposing ridges walls 72 and into preselected orifices 66. The offset channels 64 have the dual function of counter-sinking the locking pins 70 within the trough 68 beneath the ridge walls 72 thereby preventing the pins 70 from engaging the structure 14 that the device 10 physically contacts, and offsetting the wall member 16 from the structure 14 a preselected distance determined by the lateral dimension of opposing congruent upper and lower outer walls 74 and 76 of the offset channels 64. The ridge walls 72 of the offset channel 64 are coplanar, rectangular configured, when taking a front elevation view, surfaces that engage a structure 14 of planar or curved configuration. Generally, offset channels 64 are selected having upper and lower outer walls 74 and 76 with equal lateral dimensions. The result being a wall member 16 positioned parallel to the structure 14. However, varying the lateral dimensions of the wall members 74 and 76, the wall member 16 may be positioned at an angle to the structure 14. Thus, the upper channel 28 may be positioned closer to the structure 14 than the lower channel 34 resulting in a device 10 configuration that ultimately positions the bumper post 12 such that the longitudinal axis forms an acute angle with the ground.

The post member 18 includes two post channels 78 having a substantially square configuration (see FIG. 3) when taking a view of either end 79 and 81 with a passageway 80 therethrough, and a substantially rectangular configuration when taking a top or front elevation view (see FIGS. 2 and 4), with longitudinal dimensions substantially larger than lateral dimensions and relatively larger than the longitudinal dimensions of the channels 20. A plurality of orifices 82 are positioned along the longitudinal midsection of the post channels 78 and relatively equally spaced through inner and outer planar walls 84 and 85 of each post channel 78. The perimeter of the exterior of the square configuration of either end 79 and 81 is slightly smaller than the perimeter of the square configured passageways 22 of the upper and lower channels 28 and 34. Thus, the smaller dimensioned post channels 78 are capable of snugly inserting into the slightly larger passageways 22 to ultimately be secured therein by aligning at least one of the orifices 82 of the post channels 78 with one of the orifices 24 and 30 of the upper and lower channels 28 and 34, then inserting a locking pin 70 through the axially aligned orifices.

The device 20 includes post angle members 86 integrally joined to inner walls 84 of the post channels 78. The post angle members 86 have a substantially square configuration when taking a front elevation view of the device 10 (see FIG. 4) including a passageway 88 therethrough, and a substantially rectangular configuration when taking top and side elevation views of the device 10 (see FIGS. 2 and 3) with longitudinal dimensions substantially equal to the corresponding longitudinal dimensions of the upper and lower wall angle members 36 and 38. The post angle members 86 are integrally joined to respective inner walls 84 by welding the perimeter of the square configured ends 90 to the planar inner walls 84. The angle members 86 are joined to the inner walls 84 such that the longitudinal axis of the angle members 26 are substantially perpendicular to the inner walls 84 forming substantially right angles between inner walls 84 and adjacent inner walls 92 of the post angle members 86. Further, joined post angle members 86 are positioned relatively closer to post channel ends 57 such that upper walls 94 and lower walls 96 are planar with corresponding upper and lower walls 98 and 100 of the post channels 78.

Referring to FIGS. 1 and 5, in operation, a dimension is selected to position a bumper post 12 adjacent to a structure 14 to prevent a moving vehicle from engaging the structure 12. The selected distance is measured from an outer wall 102 of the structure 14 to a wall portion 104 of the bumper post 12 closest to the outer wall 102. Each post channel 78 is snugly inserted via ends 81 into upper and lower channels 28 and 34 via passageways 22 until the distance separating the coplanar outer walls 106 of the post angle members 86, and the inner walls 44 and 46 of the upper and lower wall angle members 36 and 38 equals the selected distance separating the outer wall 102 of the structure 14 from the wall portion 104 of the bumper post 12. An offset channel 64 is positioned adjacent to inner walls 26 and 32 such that the trough 68 is exposed and the ridges 72 ultimately contact the structure 14. At least one set of orifices in the offset channel 64, inner wall 26 and post channel 78 are axially aligned to allow a locking pin to be inserted therethrough until an inner wall 108 of the head 109 of the locking pin 70 engages a trough wall 110 of the offset channel 64. The pin 70 is secured in position via a cotter pin 112 an element well known to those of ordinary skill in the art, inserted through an orifice 114 through the exposed end 116 of the pin 70 protruding through an outer wall 118 of the upper channel 28. Similarly, at least one set of orifices in the offset channel 64, inner wall 32 and post channel 78 are axially aligned to allow a locking pin to be inserted therethrough and secured as detailed above. In place of the pin assembly detailed above, a clevis pin may be used which is well known to one of ordinary skill in the art.

Upon securing the post channels 78 to the upper and lower channels 28 and 34 of the wall member 16, a person positions the device 10 such that the inner walls 26 and 44 of the upper channel 28 and upper wall angle member 36 engage the structure 14; and such that the inner walls 32 and 46 of the lower channel 34 and lower wall angle member 38 engage the structure 14. Another person then forcibly positions the bumper post 12 against the post member 18 such that the post's cylindrical wall engages the inner walls 84 of the post channels 78, and outer walls 106 of the post angle members 86. Once positioned, the bumper post 12 is anchored in the ground by a buried concrete block in which a bottom end 120 of the post 12 is secured.

The offset channels 64 may be deleted from the device 10 by inserting a shorter version of the locking pin 70 through the axially aligned orifices via the outer walls 118 of the upper and lower channels 28 and 34. The shorter pins 70 would not protrude through the inner walls 26 and 32 of the upper and lower channels 28 and 34 which allows the offset channels to be deleted but prevents the securing of the positions of the locking pins 70 by utilizing the cotter pin technique detailed above. Although the above operation plan details the use of only one locking pin, when including the offset channels 64, at least two locking pins 70 should be utilized.

Figure 6:
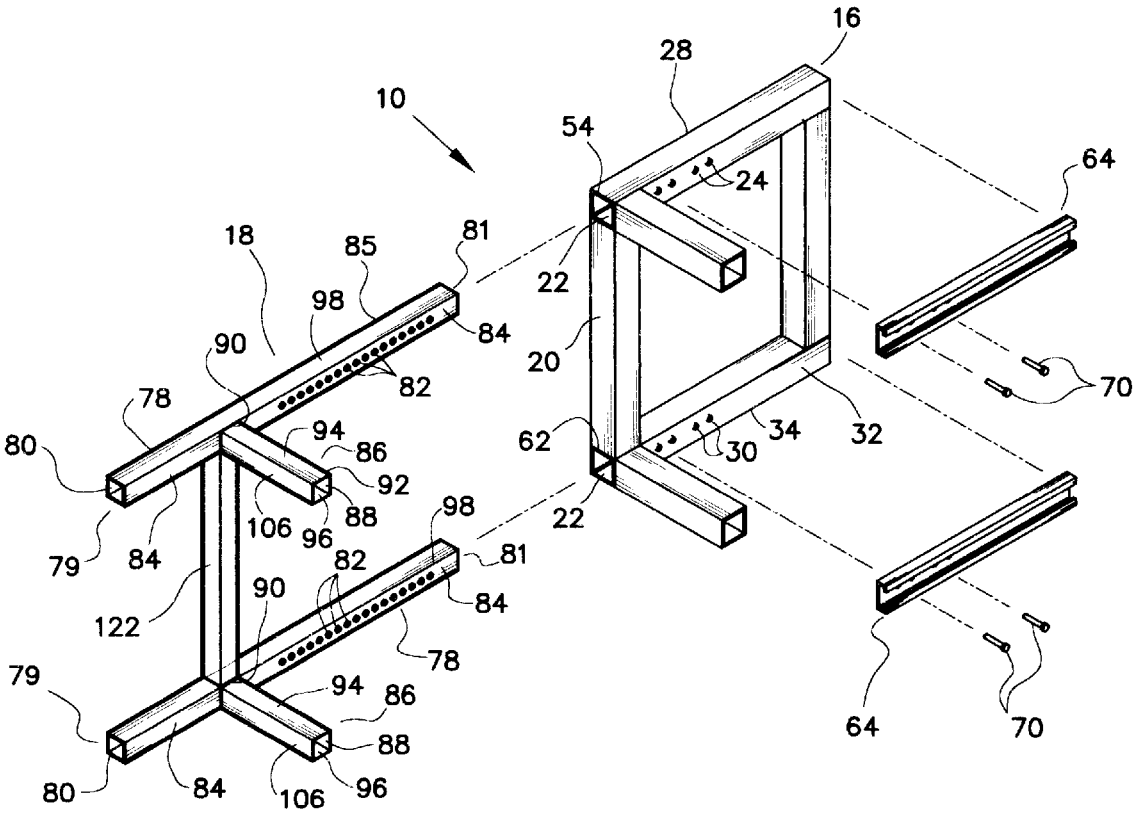
FIG. 6 is an exploded perspective view of an alternative embodiment of the device depicted in FIG. 1 in accordance with the present invention.
Figure 9:
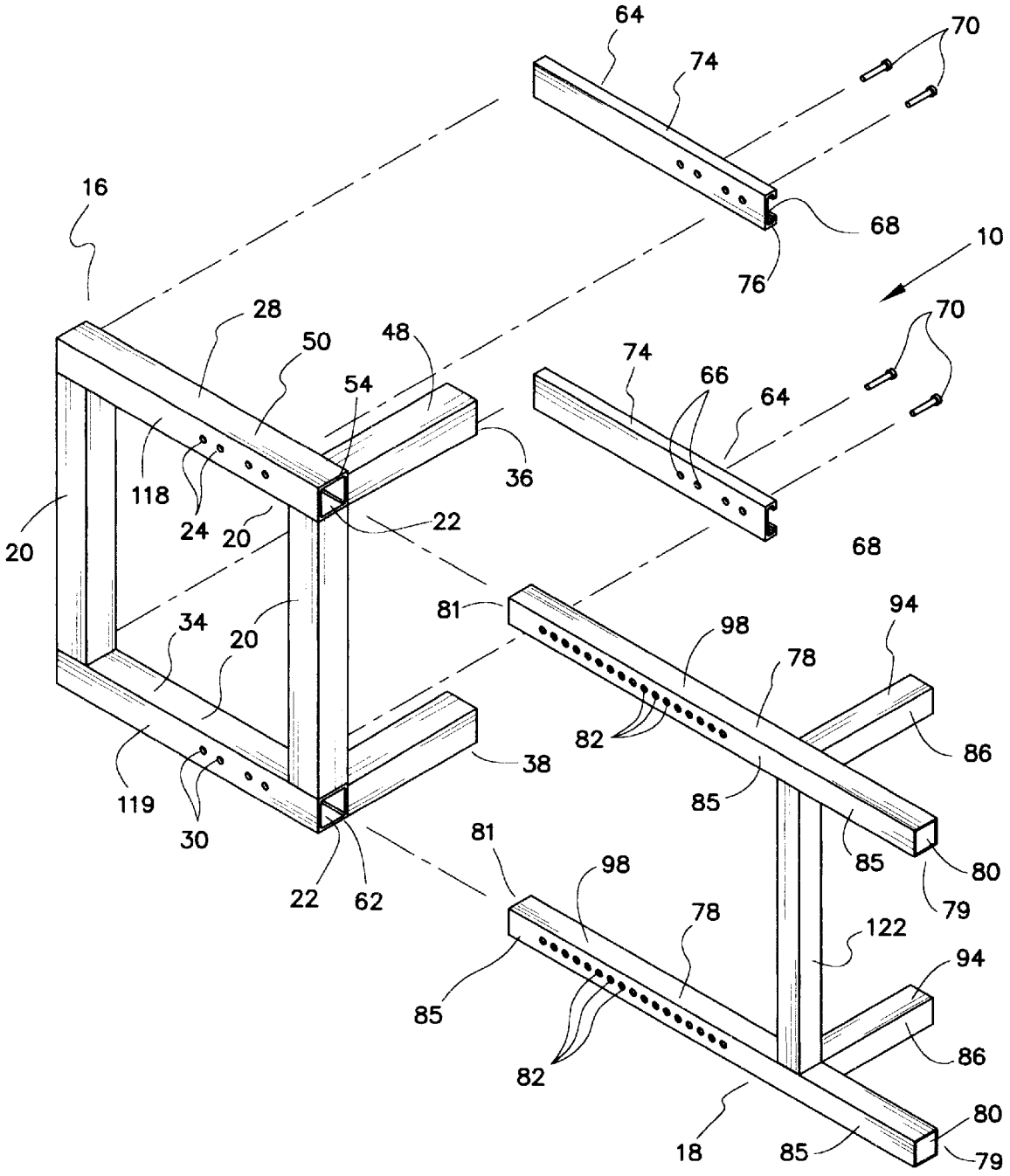
FIG. 9 is an exploded rear perspective view of the alternative embodiment depicted in FIG. 6.

Referring to FIGS. 6 and 9, an alternate embodiment of the device 10 is depicted. A connecting bar 122 is includes that spacially connects the post channels 78 together. The connecting bar 122 is dimensioned to axially align the longitudinal axes of the post channels 78 with the corresponding longitudinal axes of the upper and lower channels 28 and 34 to provide faster assembly of the wall and post members 16 and 18. Joining the two post channels 78 together, requires that only one post channel 78 be secured to corresponding upper or lower channel 28 and 34 to ultimately position a bumper post 12 adjacent to a structure 14.

The connecting bar 122 is integrally joined to the post channels 78 via respective lower and upper planar walls 100 and 98 such that the longitudinal axis of the bar 122 is perpendicular to both walls 100 and 98. The connecting bar 122 is fabricated from light weight aluminum, has a square configuration with a passageway therethrough when taking a view of either end, and a rectangular configuration when taking a front or side elevation view. The bar 122 is proximally positioned upon the lower and upper walls 100 and 98 of the post channels 78 so as to allow the longitudinal axis of the bar 122 to intersect with the longitudinal axes of the post angle members 86; however, the position of the bar 122 does not prevent the inner walls 92 of the post angle members 86 from engaging the outer walls 52 and 60 of the upper and lower wall angle members 36 and 38.

Figure 7:
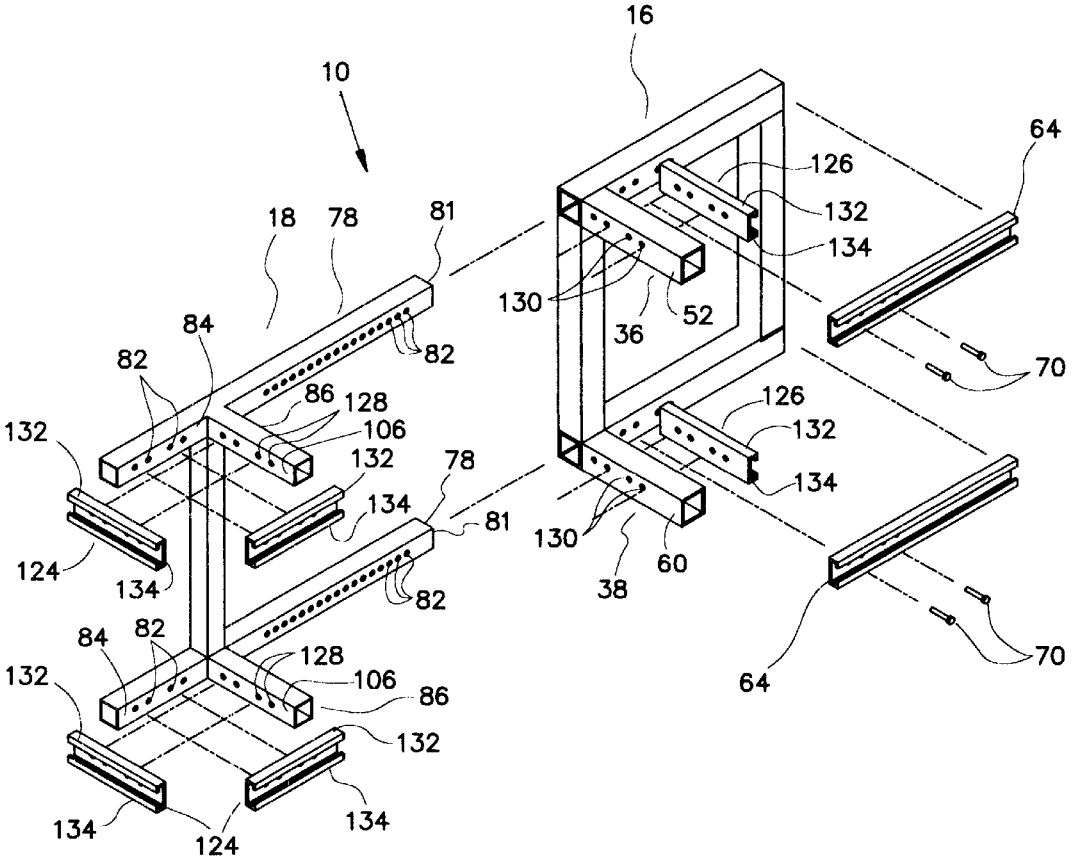
FIG. 7 is an exploded perspective view of another alternative embodiment of the device depicted in FIG. 1 in accordance with the present invention.
Figure 8:
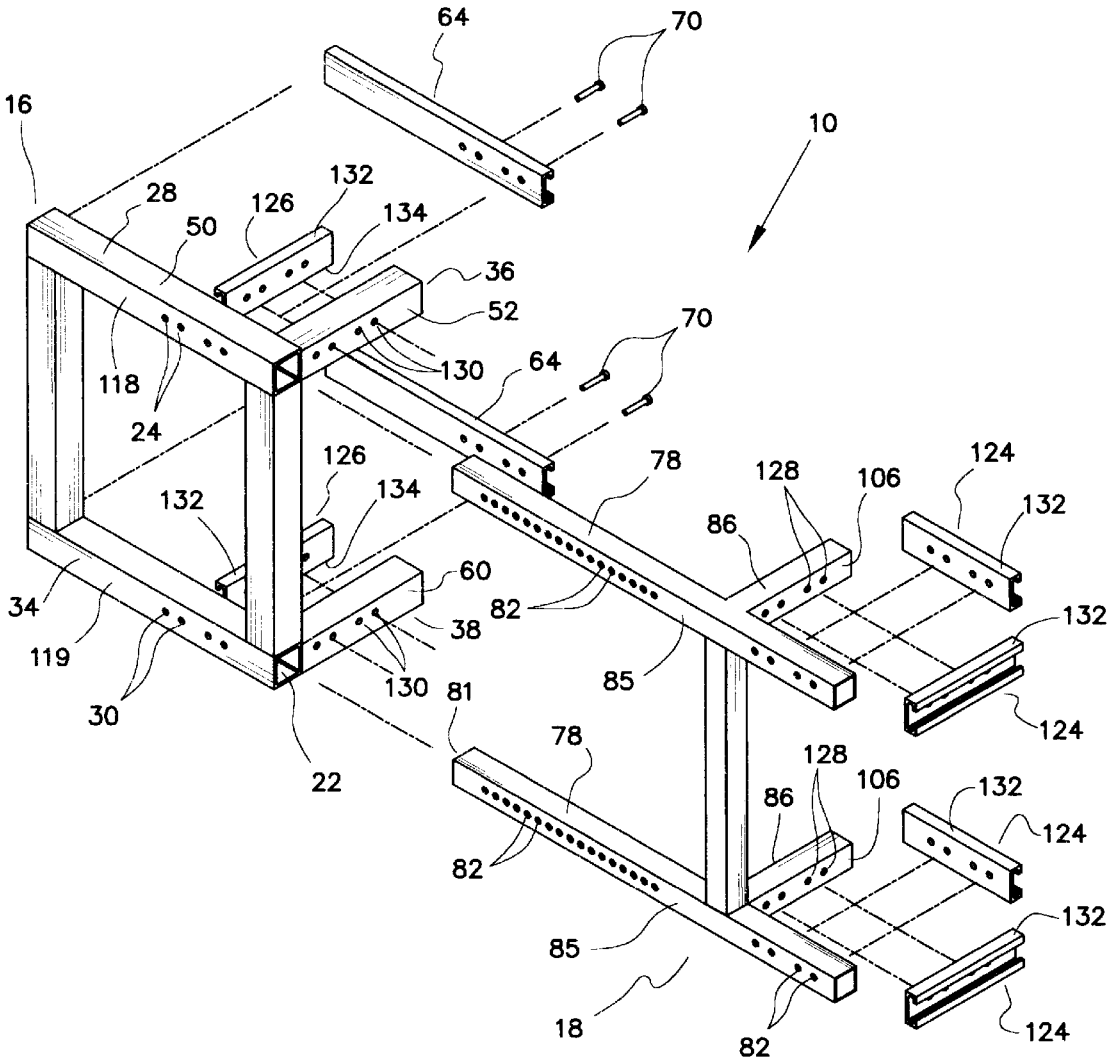
FIG. 8 is an exploded rear perspective view of the alternative embodiment depicted in FIG. 7.

Referring to FIGS. 7 and 8, another alternate embodiment of the device 10 is depicted. The ultimate positioning of the bumper post 12 may require offsetting the bumper post 12 in a myriad of directions and/or distances in relation to the structure 14. This positioning requirement is accomplished by including four offset channels 124 that engage the bumper post 12, and two offset channels 126 that engage the outer wall 102 of the structure 14. The offset channels 124 and 126 are joined to respective portions of the device 10 via orifices and locking pins as detailed above. The four bumper post offset channels 124 are secured to the outer walls 106 of the post angle members and adjacent post channel inner walls 84 via orifices 128. The two outer wall offset channels 126 are secured to the inner walls 44 and 46 of the upper and lower channels 28 and 34 via orifices 130. The four bumper post offset channels 124 and the two outer wall offset channels 126 are configured substantially the same as the offset channels 64 detailed above; except for offset channels 64 having a relatively greater longitudinal dimension than the post and outer wall offset channels. Varying the lateral dimension of the planar upper and lower walls 132 and 134 of the offset channels 124 and 126, allows the bumper post to be positioned at any predetermined alignment and distance from the post member 18 and ultimately the structure 14.

Although the configurations detailed above incorporate planar walls, cylindrical configurations for the various components could also be utilized but with reduced alignment precision between respective orifices of the insertion and receiving members.

Further, the embodiment described herein describes a bumper post 12 adjacent to a structure 14. The invention could also be used to align and position fence posts, sonna tubes, pier supports and similar constructs adjacent to preselected structures.

The foregoing description is for purposes of illustration only and is not intended to limit the scope of protection accorded this invention. The scope of protection is to be measured by the following claims, which should be interpreted as broadly as the inventive contribution permits.

I claim:

1. A bumper post offset positioning device comprising:

first and second members;

means for engaging said first member of said device with a structure;

means for engaging said second member of said device with upper and lower portions of a bumper post;

means for adjustably joining said first member and said second member;

means for adjustably offsetting said first member a first distance from the structure, said first member adjustable offsetting means including a channel member removably received upon an inner wall of said first member; and means for adjustably offsetting the bumper post a second distance from said second member.

2. A bumper post offset positioning device comprising:

first and second members;

means for engaging said first member of said device with a structure;

means for engaging said second member of said device with upper and lower portions of a bumper post;

means for adjustably joining said first member and said second member;

means for adjustably offsetting said first member a first distance from the structure; and means for adjustably offsetting the bumper post a second distance from said second member, said bumper post offsetting means including a channel member removably received upon an inner wall of said second member.

* * * * *